United States Patent [19]

Brunet et al.

[11] Patent Number: 4,852,666

[45] Date of Patent: Aug. 1, 1989

[54] APPARATUS FOR AND A METHOD OF DRILLING OFFSET WELLS FOR PRODUCING HYDROCARBONS

[76] Inventors: Charles G. Brunet; Alton Watson, both of 3613 A Amb. Caffery Pkwy., Suite 9, Lafayette, La. 70503

[21] Appl. No.: 178,500

[22] Filed: Apr. 7, 1988

[51] Int. Cl.[4] ..... E21B 7/08; E21B 7/06

[52] U.S. Cl. ..... 175/61; 175/62; 175/73; 175/80; 175/82; 166/117.5

[58] Field of Search ..... 166/117.5, 50; 175/61, 175/62, 73, 79, 80, 82, 83; 299/19

[56] References Cited

U.S. PATENT DOCUMENTS

| | | | |
|---|---|---|---|
| 2,173,531 | 9/1939 | De Long | 175/83 |
| 2,404,341 | 7/1946 | Zublin | 175/61 |
| 4,194,580 | 3/1980 | Messenger | 174/61 |
| 4,386,665 | 6/1983 | Dellinger | 175/61 |
| 4,431,069 | 2/1984 | Dickinson, III et al. | 175/61 |
| 4,511,000 | 4/1985 | Mims | 166/50 X |
| 4,519,463 | 5/1985 | Schuh | 166/50 X |
| 4,601,353 | 7/1986 | Schuh et al. | 175/62 X |

*Primary Examiner*—Bruce M. Kisliuk

*Attorney, Agent, or Firm*—Pravel, Gambrell, Hewitt, Kimball & Krieger

[57] ABSTRACT

A directional guidance device, for deflecting a drill bit away from the longitudinal axis of a substantially horizontal section of a wellbore, takes advantage of gravitational force to move a deflector member therein between first and second positions. In the first position, the deflector member prevents the drill bit from advancing past the directional guidance device. In the second position, the deflector member allows the bit to pass out of the guidance device, and deflects the bit away from the longitudinal axis of the horizontal section of the wellbore.

30 Claims, 5 Drawing Sheets

FIG. 5.
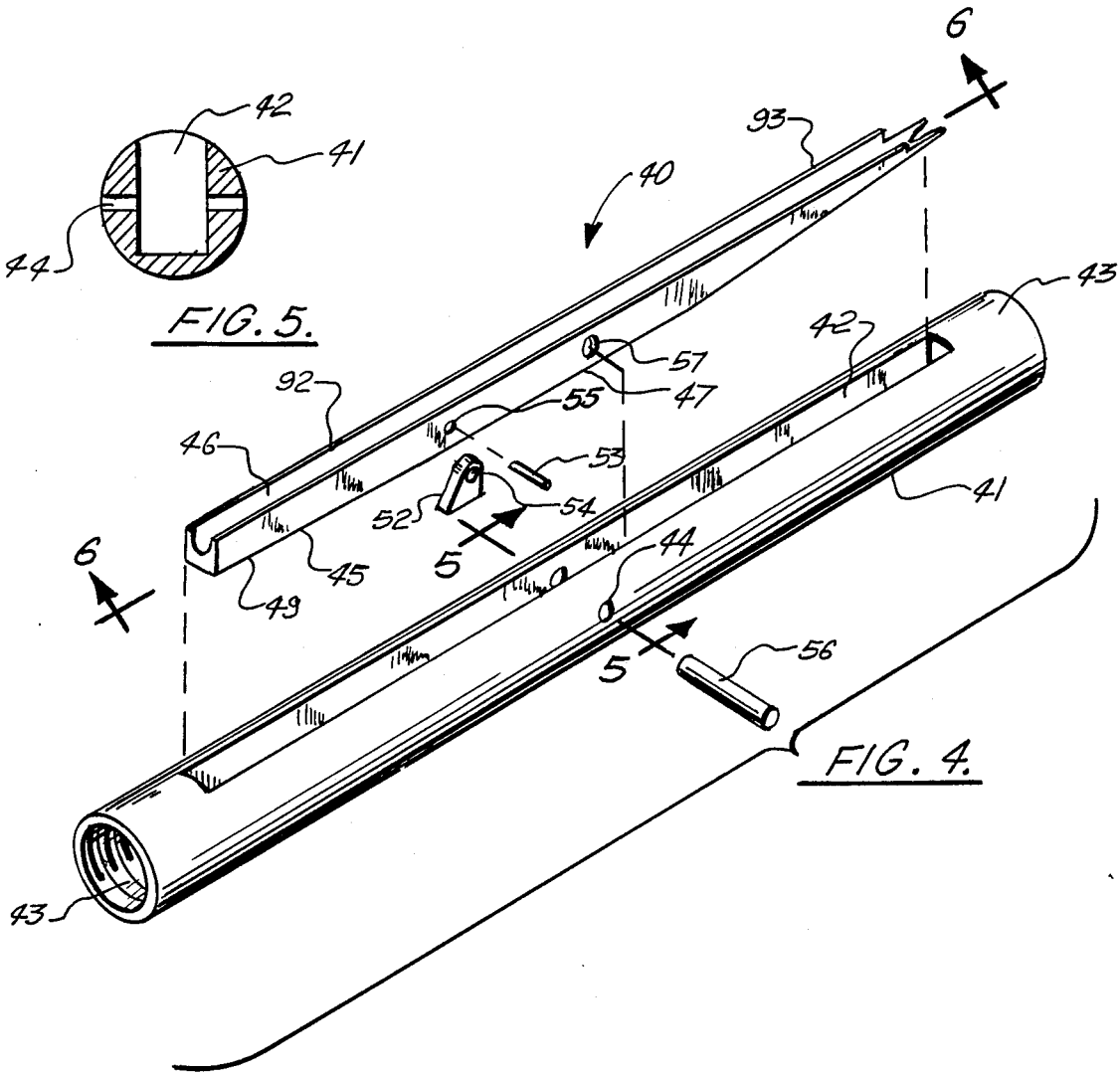
FIG. 4.
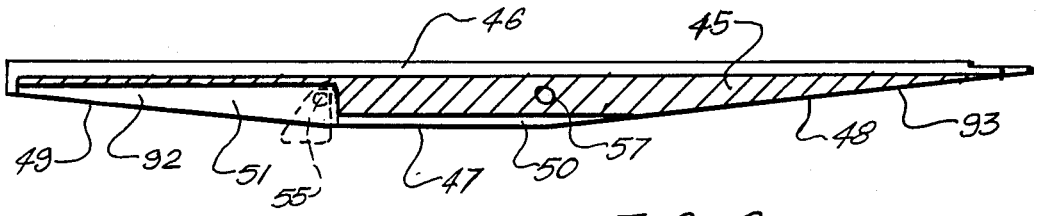
FIG. 6.

APPARATUS FOR AND A METHOD OF DRILLING OFFSET WELLS FOR PRODUCING HYDROCARBONS

BACKGROUND OF THE INVENTION

1. Field of the Invention

The present invention relates to an apparatus for and a method of drilling offset wells for producing hydrocarbons.

2. General Background

Conventional wells drilled for producing hydrocarbons comprise a single vertical bore hole which pierces a hydrocarbon-containing formation. The effective surface area of the well is equal to the perimeter of the bore hole times the thickness of the formation. If the hydrocarbons are relatively fluid and the flow rate of the hydrocarbons is sufficiently fast, this surface area is satisfactory. When the hydrocarbons are relatively viscous, or for some other reason the flow rate is relatively slow, it is desirable to maximize the effective surface area of the well. Some oil producers increase the effective surface area of conventional vertical wells by drilling horizontal wellbores into the formation from the vertical bore hole. Various methods exist for producing these horizontal wellbores.

Four different technologies are currently commercially available for drilling horizontal wellbores. The primary distinction between the technologies is based on the rate of change in the inclination angle incorporated in the transition from vertical to horizontal:

(1) instantaneous, in the shaft-radial method, (2) short ($1\frac{1}{4}$°–3° per foot), (3) medium (18°–30° per 100 feet), (4) long, or conventional ($1\frac{1}{2}$°–6° per 100 feet).

The short-radial technique, often referred to as the "wagon wheel" method because of the resemblance when viewed from above, involves the drilling of a large diameter shaft vertically to the oil reservoir. Drilling equipment is lowered into the shaft, and horizontal wells are drilled radially along the perimeter of the shaft. Although a vast amount of reservoir contact results from this technique, the initial expense and considerable construction time, in addition to depth limitations and safety considerations associated with the shaft, limit the practical applicability of this method to most oil reservoirs.

The short radius, or drain hole, method involves drilling several holes radially from an existing wellbore. The transition from vertical to horizontal is performed in from 1 foot to 30 feet, depending on whether the knuckle joint (wigglies) or coiled tubing method of drainhole drilling is employed. This method maximizes the amount of horizontal bore length generated for the total hole drilled and allows the use of the existing casing in a wellbore. Its popularity has been severely restricted due to the lack of existing logging techniques and completion technologies suitable for use with the short radius approach. This has resulted in most of the drainhole completions to date being left uncased, or barefoot.

The newest of the horizontal well drilling technology is that associated with medium radius drilling. The 350 foot radius of curvature build section allows for a reasonably short transition from vertical to horizontal, yet facilitates longer drainhole lengths than the short radius wellbore. The major drawback of this system, as with the short radius approach, is that compatible logging and completion equipment has not yet been developed.

The long radius, or conventional, method has been the most popular in the last few years, among the major oil companies, particularly in the case of using horizontal drilling technology in conjunction with a new well. Although several thousand feet of drilling is required to make the transition from vertical to horizontal, this approach has the distinct advantage of being compatible with much of the existing logging equipment and completion methods.

Mining techniques have been used for oil production in numerous countries over many centuries. Only a few projects have been undertaken in the last century, however.

There has been a resurgence of interest in oil mining both by governments and the private sector in recent years. The reason for this interest is the high percentage of recovery of oil in place afforded by this technology. Present estimates are that 300 billion barrels of light crude and 200 billion barrels of heavy oil will remain in place in the U.S. and Canada after development by existing primary and secondary recovery methods.

Primary recovery refers to the development of reserves by conventional surface wells and pumping equipment; nothing is added to the reservoir to increase or maintain drive energy nor to sweep the oil towards the well. Primary recovery methods tend to produce 15–20 percent of the oil in place.

Secondary recovery involves the addition of fluid to the reservoir to supplement depleted reservoir energy pressure and sweep the oil towards and into the production well. Waterfloods and steamfloods are typically secondary recovery processes. Secondary methods normally recover 15–20 percent of the oil in place.

U.S. government studies estimate that 50% to 90% of the "lost" oil could be recovered using oil mining techniques.

The oil mining industry can be classified into two categories depending on whether the primary operations are located 1) on the surface or 2) underground. Surface mining has proven over the years to be, by far, the cheapest and simplest extraction method. Basically, the overburden material is stripped away to expose the oil bearing host rock. This host rock is then directly mined. Both the overburden stripping and host rock mining operation require extensive use of heavy earth moving equipment, such as draglines, bulldozers, and bucketwheel excavators. Either large dumptrucks or conveyor systems are then employed to transport the oil material to a processing facility.

Variations of surface mining methods include (1) terrace pit, (2) strip mining, and (3) open pit mining. The primary limitation of all surface mining methods is the depth of overburden material that can be practically handled (generally 250 feet or less). Advantages of surface methods include low extraction cost and high percentage of recovery of the oil in place.

The second mining group include systems that occur underground. Although generally more expensive than surface systems, underground methods hold far more potential for oil recovery due to the far greater depths at which the systems are feasible. Underground systems can be divided into (1) processes in which the oil bearing rock is physically removed from the mine, as in direct stoping and block caving systems, and (2) processes in which mining is only a means to gain access to the proximity of the oil bearing formation, in order to limit the amount of drilling that must be done to produce the reservoir. Underground drainage methods include (1) shatter and drain systems, (2) drainage with steam methods, and (3) gravity drainage.

The main advantage of the underground drainage methods is in allowing the spacing of wells in a much denser configuration than would be possible if wells were drilled from the surface. This results in lower recovery cost per barrel of oil and a higher recovery percentage of oil in place as compared to conventional surface wells. Limitations or requirements of potential underground mining reservoir candidates include:

(1) location of a competent rock layer adjacent the interval to be produced;

(2) formation temperature not exceeding worker comfort levels (although this limit changes by geographical location in the U.S., the depth limitation due to temperature levels is generally in the range of 4,000–6,000 feet).

Underground mining projects normally involve high initial capital costs, often in the range of 20 million to 350 million dollars. This would somewhat limit the investment sources to governments and sizable private entities.

In the early 1980's, Petroleum Mining Corp. of Dallas, Tex. considered an oil mining operation involving digging 10 foot high by 10 foot wide tunnels underneath a formation, then drilling a plurality of drain holes up into the formation in a number of different orientations from a number of drill rooms positioned adjacent the tunnels. Construction of these tunnels would be very expensive, and there would always be the danger that the tunnels might collapse on the underground workers.

U.S. Pat. No. 4,519,463 discloses a method of producing hydrocarbons comprising drilling a primary wellbore having a curved section drilled at an angular rate of build of from about 2.5° to 6° per 100 feet of primary wellbore length and an essentially horizontal section at the end of the curved section. Drainhole wellbores are then drilled from the essentially horizontal section, the drain hole well bores including a curved portion drilled at an angular rate of build up from about 0.2° to about 3° per foot of drain hole wellbore length, and a substantially straight portion at an angle of approximately 90° from the longitudinal axis of the essentially horizontal section of the primary wellbore. The drainhole wellbores, due to the angular rate of build of their curved sections, cannot be logged or completed with existing logging and completion equipment.

SUMMARY OF THE PRESENT INVENTION

The present invention comprises a method of producing hydrocarbons and an apparatus which can be used in the method. The method comprises drilling a wellbore including a slanted, substantially straight section, a substantially curved section, and a substantially straight, substantially horizontal section. The slanted section is drilled at an angle between 0° and 90° from horizontal, and preferably at an angle of approximately 60°. The substantially curved section is drilled at an angular rate of build of between 3° and 10° per 100 feet, and preferably at an angular rate of build of 7½° per 100 feet. Offset wells are then drilled from the substantially horizontal section of the wellbore. These offset wells include a substantially curved portion and a substantially straight portion. The substantially curved portion is preferably drilled at an angular rate of build of between 3.3° and 15° per 100 feet, and more preferably at an angular rate of build of 6.6° per 100 feet. The substantially straight portion is preferably drilled at an angle of between 10° and 45° from horizontal, and more preferably at an angle of 30° from horizontal.

Because of the relatively long angular rate of build at which the substantially curved section of the wellbore and the substantially curved portion of the offset wells are drilled, and the relatively small angles at which the slanted section of the wellbore and the slanted portions of the offset wells are drilled, the wellbore and the offset wells can be logged and completed by existing, commercially available logging and completion equipment.

By drilling the offset wells from a substantially horizontal wellbore, a greater number of offset wells can be drilled from the wellbore than can be drilled from a conventional, vertical wellbore, for a given spacing of sets of offset wells in a formation which extends further laterally than vertically (as is the case with most oil reservoirs), resulting in increased effective surface area of the well.

The apparatus of the present invention comprises a directional guidance device for deflecting a drill bit away from the longitudinal axis of a substantially horizontal section of the wellbore. The directional guidance device takes advantage of gravitational force to move a deflector member therein between first and second positions. In the first position, the deflector member prevents the drill bit from advancing past the directional guidance device. In the second position, the deflector member allows the bit to pass out of the directional guidance device and deflects the drill bit away from the longitudinal axis of the directional guidance device. The deflector member is moved between the first and second positions by rotating the directional guidance device and advancing or withdrawing the drill bit.

It is an object of the present invention to provide a method of producing hydrocarbons in which a plurality of offset wells, which can be logged and completed by existing, commercially available logging and completion equipment, are drilled.

It is another object of the present invention to provide a method of producing hydrocarbons which increases the effective surface area of a well.

It is also an object of the present invention to provide apparatus for drilling offset wells from a substantially horizontal section of a wellbore.

A further object of the present invention is to provide apparatus, for drilling offset wells from a substantially horizontal section of a wellbore, which utilizes gravitational force to move a deflector member therein between a first position in which the deflector member prevents advancement of a drill bit out of the apparatus and a second position in which the apparatus deflects the bit from the longitudinal axis of the substantially horizontal section of the wellbore.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 4 is an exploded, perspective view of the device of the present invention.

FIG. 5 is a cross-sectional view taken in the direction of arrows 5—5 in FIG. 4.

FIG. 6 is a sectional view in the direction of arrow 6—6 in FIG. 4.

DETAILED DESCRIPTION OF THE PREFERRED EMBODIMENT

Figure 1:
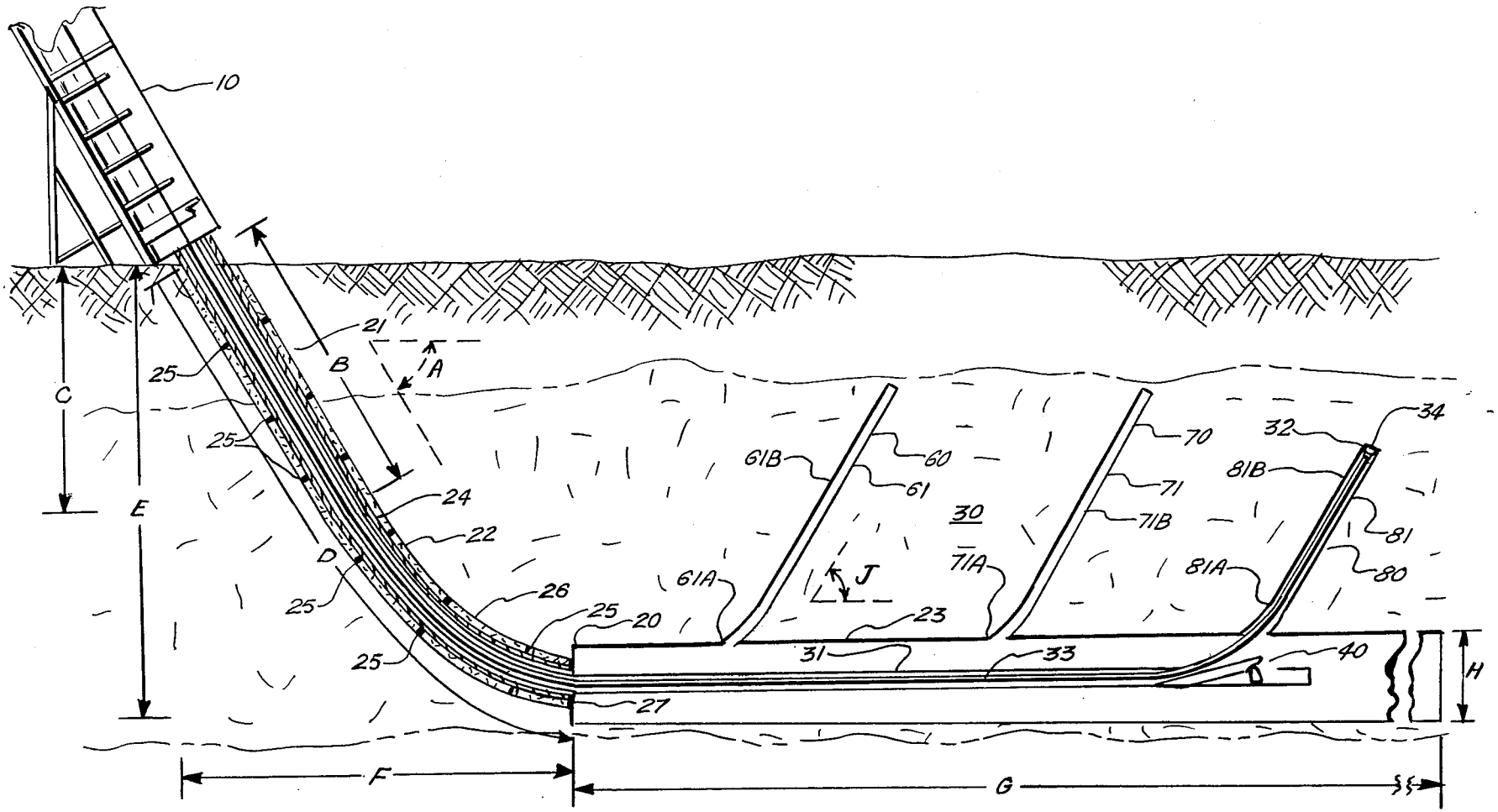
FIG. 1 is a partially sectional view illustrating the method of the present invention.

Referring now to FIG. 1, a slant drilling rig 10 is set up where wellbore 20 is to be drilled. Drilling rig 10 may comprise a rig used to drill pipeline crossings under rivers. Rig 10 is designed to thrust drill pipe into the ground at shallow angles. Rig 10 is self-contained and generates its own power. It is easily transportable and mobile enough to reach difficult locations. Drilling rig 10 requires a minimum of manpower to operate. A pilot hole (not shown), for example, 3½ inches in diameter, is spudded into the ground at an angle A (FIG. 1) of between 0° and 90° (inclusive) from horizontal, preferably at an angle of between 15° and 75° from horizontal, more preferably between 25° and 65° from horizontal, and most preferably approximately 60° from horizontal.

A drilling assembly (not shown) comprising, for example, a 3½ inch diameter bit, a small diameter non-magnetic mud motor and drill collars, an orientation sub and 2⅞ inch drill pipe is used to drill the pilot hole. Drilling fluid (mud) is pumped down the drill pipe. The mud motor converts the energy of the flowing mud into rotational energy in the drill bit at the end of the motor. The mud motor contains a small bend just behind the bit. The bend allows the pilot hole to be curved in the direction of the bend as the drill pipe is thrust forward.

An electronic survey instrument is placed inside the drill collars just behind the bend. The electronic instrument may comprise one of many commercially available instruments which gives continuous data concerning the vertical inclination and magnetic azimuth of the pilot hole, and the orientation of the bend. This information is transmitted via a wireline to a computer at the surface, where calculations are made using this information to determine the location of the drill bit, and steering adjustments are made accordingly.

The slant drilling rig may comprise, for example, a rig similar to those used to drill directional pilot holes under waterways when installing pipelines. Angle A (most preferably 60° from horizontal) is maintained for a suitable drilled length B (for example 1,450 feet) corresponding to a true vertical depth C (for example 1,250 feet when B equals 1,450 feet) to drill the first, substantially straight section 21 of wellbore 20. At this point, a second, substantially curved section 22 of wellbore 20 is begun. Section 22 is drilled at an angular build rate of preferably between 3° and 10° per 100 feet. The angular build rate is more preferably approximately 7½° per 100 feet. The angular rate of build continues until the leading end of the pilot hole reaches 0° from horizontal (that is, a horizontal orientation). When A equals 60°, B equals 1,400 feet , and the angular rate of build is approximately 7½° per 100 feet, this should occur at a drilled length D of approximately 1,800 feet, a total vertical displacement E of approximately 1,600 feet, and a total horizontal displacement F from drilling rig 10 of approximately 1,350 feet.

The pilot hole is then advanced horizontally a suitable distance past this point (for example, thirty feet).

An open-bore drill bit (not shown) is then attached to, for example, a five inch oil field drill pipe overdrilling string (not shown) the open-bore drill bit may be, for example, a twelve inch bit. The over drilling string is rotatably advanced over the pilot hole drill pipe. The open-bore drill bit follows the path of the pilot drill pipe, and enlarges the first section 21 and second section 22 section of the wellbore 20 to twelve inches in diameter. The overdrilling drill bit is advanced to the lowermost end of the second section 22 of wellbore 20. The pilot hole drill string is then removed from wellbore at 20, followed by the overdrilling string.

Casing/cementing operations are then begun. A string of casing 24 of a suitable diameter (for example, 9⅝ inches), having a guide shoe 27 on its leading end, is rotatably advanced along first section 21 and second section 22 sections of wellbore 20. Casing 24 has spaced apart subs 25 which clean the walls of wellbore 20 and position casing 24 concentrically in wellbore 20 to facilitate a successful cement job. Casing 24 is advanced to the lowermost end of second, curved section 22 of wellbore 20. It is then cemented in place with cement 26. Cement 26 may either be circulated back to the surface, or stopped along a suitable point along casing 24. A cement bond log is run at this time to determine whether the cement job is satisfactory. The pilot hole drill string (not shown) is then advanced through casing 24 to the end of second section 22 of wellbore 20. The electronic survey instrument is pumped on a wireline through a side entry sub and is oriented by means of a standard muleshoe orienting sub. A third, substantially straight, substantially horizontal section 23 of wellbore 20 is then begun by drilling a horizontal pilot hole (not shown) beginning at the lowermost end of second section 22. As drilling of the pilot hole advances in section 23, the wireline is strapped to the outside of the pilot hole drill string as additional pipe joints are added. The pilot hole in section 23 of wellbore 20 extends substantially horizontally for a distance G (of, for example, 1,500 feet) in formation 30.

The electronic survey instrument is then severed at the side-entry sub and is removed from wellbore 20. The overdrilling string, with an open-bore bit small enough to fit in casing 24 (for example, 8 inches in diameter when casing 24 is 9⅝ inches in diameter), is advanced along the pilot hole drill string to the beginning of third section 23 of wellbore 20. The overdrilling string is then rotatably advanced along the pilot hole drill string to the end of third section 23, enlarging the diameter of third section 23. The pilot hole drill string is then withdrawn from wellbore 20, followed by the overdrilling string.

A hydraulically activated hole opener with a guide pup attached to its leading end is run on the overdrilling string to the end of third section 23. The guide pup may have a diameter of, for example, seven inches when third section 23 of wellbore 20 has a diameter of 8 inches. Mud (drilling fluid) is pumped down through the overdrilling string, and the pressure of the mud activates the hole opener, causing it to expand to its working diameter (for example, 15 inches). The hole opener is simultaneously rotated and pulled by drilling rig 10, enlarging the diameter of the third section 23 of wellbore 20 to a diameter H (15 inches when the working diameter of the hole opener is 15 inches). The hole opener is pulled to the beginning of third section 23, where the pump pressure is stopped. The hole opener then collapses, and is withdrawn from wellbore 20 through casing 24.

A directional guidance device 40 (FIG. 4) is then attached to the end of a drill string 31 (which may be, for example, five inches in diameter).

Directional guidance device 40 (see FIG. 4) comprises a substantially cylindrical housing member 41 having a longitudinally extending slot 42 therein, internally threaded ends 43, and a transverse bore 44 at its center.

A deflector member 45 fits within slot 42 of substantially cylindrical member 41. Deflector member 45 has an upwardly opening, substantially straight, longitudinal, substantially semi-cylindrical groove 46 (FIG. 4) disposed in the top thereof. A first bottom portion 47 of deflector member 45 is parallel to groove 46, a second bottom portion 48 of deflector member 45 is substantially straight and extends upwardly, when groove 46 is horizontal, from first bottom portion 47, and a third bottom portion 49 is substantially straight and extends upwardly, when groove 46 is horizontal, from first bottom portion 47.

First bottom portion 47 of deflector member 45 has a longitudinally extending, downwardly opening, substantially straight groove 50 therein. Third bottom portion 49 has a downwardly opening recess 51 therein. Rotatably disposed in recess 51 is a support member 52. Support member 52 is attached to deflector member 45 with a pivot pin 53 extending through a hole 54 in support member 52 and a transverse bore 55 in deflector member 45.

Deflector member 45 is rotatably attached to substantially cylindrical member 41 by a pivot pin 56 (FIGS. 4 and 7) extending through transverse bore 44 in substantially cylindrical member 41 and a transverse bore 57 (FIGS. 4 and 6) in deflector member 45. A first portion 93 (FIGS. 5–8) of deflector member 45, on a first side of pivot pin 56, is heavier than a second portion 92 on a second side of pivot pin 56, so that when directional guidance device 40 is positioned such that slot 42 faces upward, deflector member 45 assumes the position shown in FIG. 7 (that is, with second bottom portion 48 contacting and parallel to bottom 58 of slot 42) and when slot 42 faces downward, deflector member 45 assumes the position shown in FIG. 8 (that is, with groove 46 parallel to the longitudinal axis of substantially cylindrical member 41).

Figure 7:
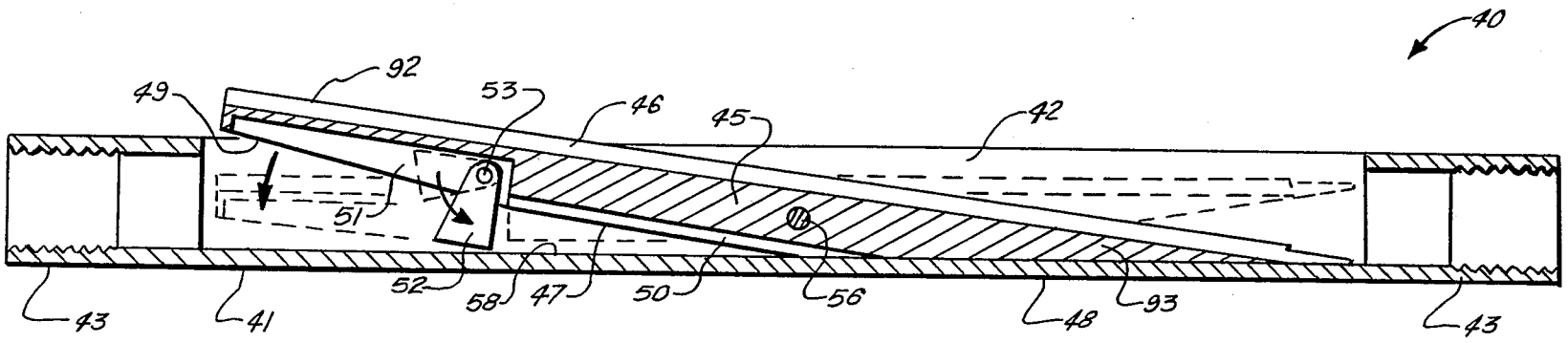
FIG. 7 is a cross-sectional view of the device of the present invention, showing a second position of the deflector member, and a first position of the deflector member in phantom.
Figure 8:
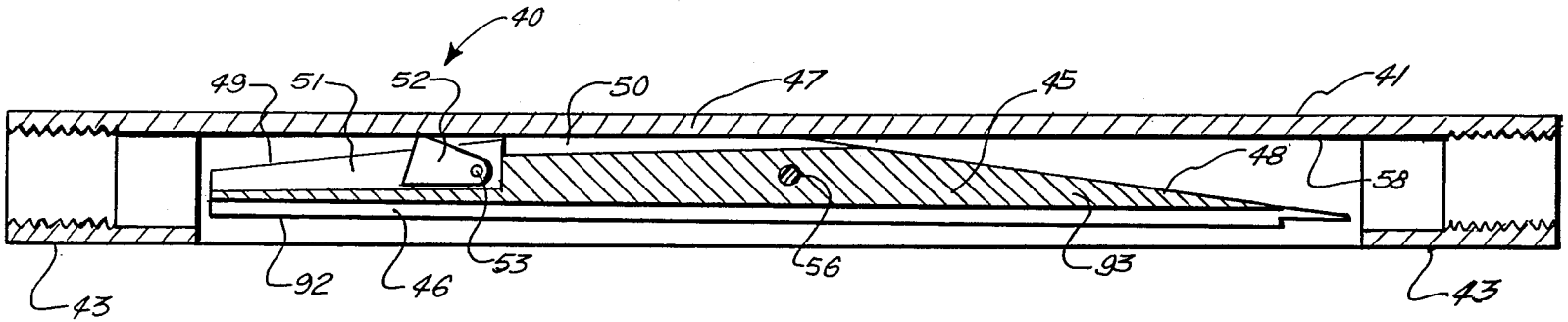
FIG. 8 is a cross-sectional view, similar to that shown in phantom in FIG. 7, of the device of the present invention.

A wireline-retrievable bar (not shown) is placed between third bottom portion 48 of deflector member 45 and bottom 58 of slot 42, wedging deflector member 45 in the position shown in phantom in FIG. 7. Directional guidance device 40 is then advanced through casing 24 and into third section 23 of wellbore 20. Directional guidance device 40 is advanced a suitable distance (for example, fifty feet) into third section 23 of wellbore 20.

The orientation of deflector member 45 is established (by using, for example, a single shot survey camera), deflector member 45 is rotated until slot 42 faces upward, and the retrievable bar (not shown) is unlodged. Deflector member 45 pivots on pin 56 such that a portion of lighter portion 92 of deflector member 45 extends out of slot 42 of substantially cylindrical member 41, and second bottom portion 48 of deflector member 45 contacts and is parallel to bottom 58 of slot 42 (see FIG. 7). Support member 52 pivots downwardly from the position shown in phantom in FIG. 7 to the position shown in FIG. 7. The retrievable bar (not shown) is brought to surface on wireline.

A directional drilling assembly, comprising a mud motor 32 at the end of a drill string 33, mud motor 32 having a drill bit 34 on its end, is run through overdrilling string 31 to directional guidance device 40. The directional drilling assembly preferably comprises the same tools used to drill the pilot hole, including an electronic survey instrument (not shown). Drill bit 34 is advanced into the right portion (in the view of FIG. 7) of groove 46 of deflector member 45, and is advanced through and out of groove 46. Groove 46 guides drill bit 34 and drill pipe 33 along deflector member 45. Deflector member 45 deflects drill bit 34 away from the longitudinal axis of third section 23 of wellbore 20.

Figure 3:
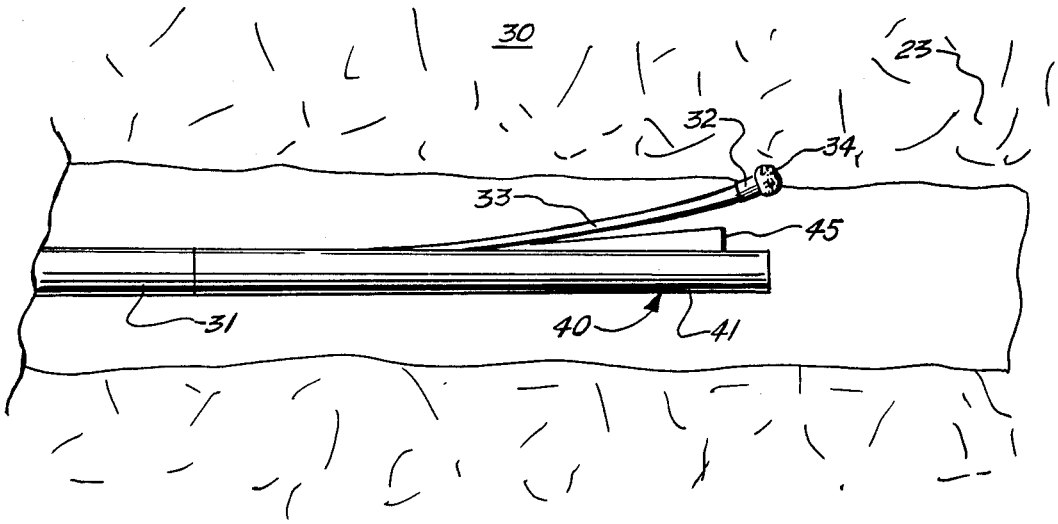
FIG. 3 is a view showing the device of the present invention being used in performing the method of the present invention.

The drilling of the first offset well 61 of the first set 60 of offset wells is now begun. Drill bit 34 is advanced such that it contacts the wall of third section 23 of wellbore 20 (see FIG. 3). Mud (drilling fluid) is then pumped down drill pipe 33, causing mud motor 32 to rotate drill bit 34. Drill bit 34 and mud motor 32 may be guided in the same manner as the pilot hole drill bit and the mud motor are. A first, substantially curved portion 61A (FIG. 1) of offset well 61 is drilled at an angular rate of build preferably between 3.3° and 15° per 100 feet. The angular rate of build is more preferably between 5° and 10° per 100 feet, and most preferably approximately 6.6° per 100 feet. Drilling of first, substantially curved portion 61A of offset well 61 continues until the leading end of offset well 61 reaches an angle J of preferably between 10° and 45° from the longitudinal axis of third, substantially straight, substantially horizontal section 23 of wellbore 20. Angle J is more preferably between 15° and 35°, and most preferably approximately 30°. A substantially straight portion 61B of offset well 61 is then drilled, at an angle J from the longitudinal axis of third section 23 of wellbore 20.

Drill bit 34 is withdrawn from offset well 61 into third section 23 of wellbore 20. Directional guidance device 40 is then rotated a suitable angle K (for example, 30°), and offset well 62 is drilled. Drill bit 34 is again advanced such that it contacts the wall of third section 23 of wellbore 20. A first, substantially curved portion, and a second, substantially straight portion of offset well 62 are drilled. The angular rate of build of the substantially curved portion and the angle between the substantially straight portion and the longitudinal axis of third section 23 are preferably the same as for offset well 61, but may be different. When offset well 62 is completed, offset wells 63–65 are drilled.

Drill bit 34 is then withdrawn into substantially cylindrical member 41 such that it is out of contact with deflector member 45. Directional guidance device 40 is then rotated such that groove 46 of deflector member 45 faces downward (see FIG. 8). When directional guidance device 40 is rotated such that groove 46 of deflector member 45 faces downward, support member 52 pivots downwardly on pivot pin 53 and deflector member 45 pivots to the position shown in FIG. 8. Mud motor 32 is advanced until drill bit 34 contacts third bottom portion 48 of the deflector member 45 and wedges deflector member 45 in the position shown in FIG. 8.

Directional guidance device 40 is then advanced a suitable distance (for example, 50 feet) along the third section 23 of wellbore 20, and a second set 70 of offset wells (FIG. 1) is drilled in the same manner as was the first set 60. After the second set 70 of offset wells is drilled, drill bit 34 is again withdrawn into substantially cylindrical member 41 of directional guidance device 40. Directional guidance device 40 is manipulated such that deflector member 45 again assumes the position shown in FIG. 8, mud motor 32 is advanced until drill bit 34 wedges deflector member 45 in that position, and directional guidance device 40 is advanced another suitable distance (for example, 50 feet) in third section 23 of wellbore 20. Drilling of the third set 80 of offset wells is then begun.

As many sets of offset wells as are desired may be drilled. When length G of third section 23 of wellbore 20 is 1,500 feet, and the distance between each set is 50 feet, 30 such sets are drilled. Each set may have as many or as few offset wells as are desired, five being shown in set 60 in FIG. 2.

At the stage shown in FIG. 1, the first two sets 60 and 70 of offset wells have been drilled, and the first offset well 81 in third set 80 is being drilled. As seen in FIG. 1, offset wells 71 and 81 include substantially curved portions 71A, 81A and substantially straight portions 71B, 81B, respectively.

Figure 2:
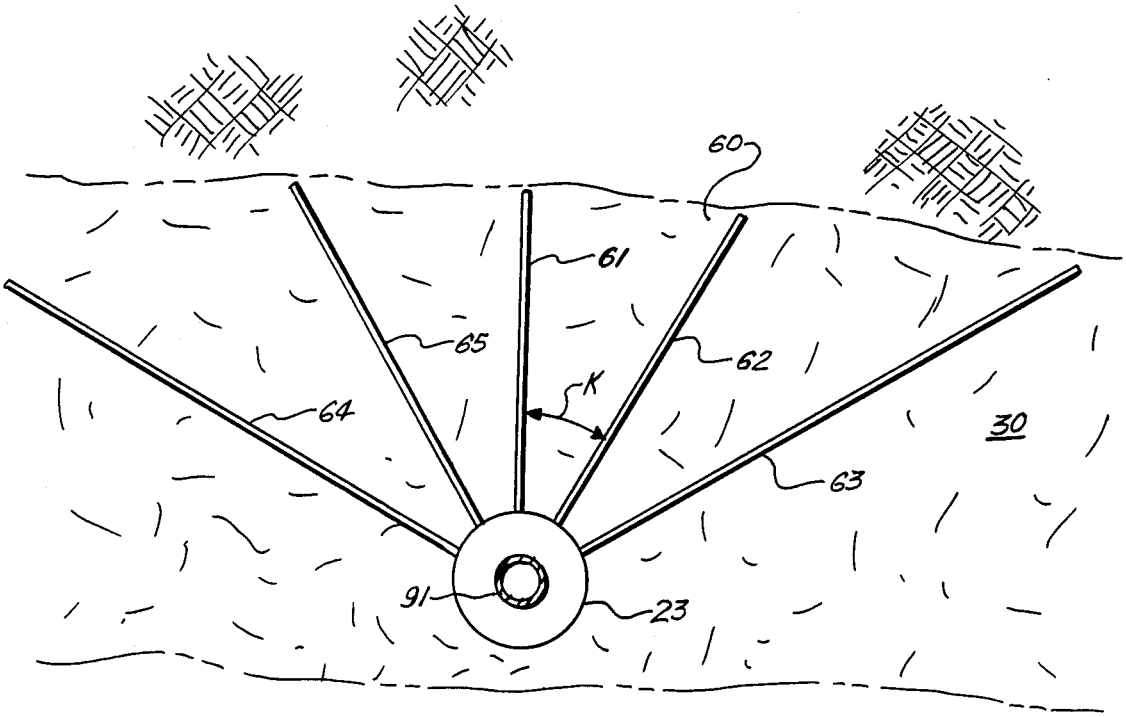
FIG. 2 is a cross-sectional view of a bore hole and offset wells drilled by the method of the present invention.

The offset wells preferably extend upward to the upper limit of formation 30 as shown by offset wells 61–65 in FIG. 2. The offset wells may be, for example, five hundred feet or more in length.

After all the offset wells are drilled, drill string 33, with mud motor 32 and drill bit 34 attached to the end thereof, is removed from wellbore 20. Drill string 31, with directional guidance device 40 attached to the end thereof, is then withdrawn from wellbore 20.

If desired, the offset wells may be completed by conventional completion methods, such as by inserting a slotted liner in each offset well. However, unless formation 30 is especially weak, completion of the individual offset wells is usually unnecessary. The offset wells (61–65, 71, 81, shown in FIGS. 1 and 2 are not completed.

A production assembly, comprising a section of slotted liner 91 (FIG. 2) (slotted liner 91 may have a diameter of, for example, 4½ to 5½ inches), is inserted along the entire length of third, substantially straight, substantially horizontal section 23 of wellbore 20. Slotted liner 91 extends a short distance into casing 24, and the annulus between lining 91 and casing 24 is sealed with, for example, a packer (not shown). A suitable pump (not shown) is inserted into casing 24, and the well is produced. Although it is possible to complete the well with a slotted liner along the entire length, horizontal section 23 of wellbore 20 could be completed with either a shorter length of slotted liner (for example, 100 feet) or a suction pipe and the rest of horizontal section 23 could be left open.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

We claim:

1. A directional guidance device for drilling offset wells from a substantially horizontal section of a wellbore, the device comprising:

a housing means;

a deflector means disposed in the housing means;

moving means for allowing the deflector means to move, by gravitational force, between a first position in which it prevents advancement of a drill bit and a second position in which it allows advancement of a drill bit and causes the drill bit to deflect from the longitudinal axis of a substantially horizontal section of a wellbore in which the device is situated; and means for attaching the device to a drill string.

2. The device of claim 1, wherein:

the housing means comprises a substantially cylindrical member having a longitudinally extending slot therein;

the deflector means comprises a deflector member disposed within the longitudinally extending slot; and the moving means comprises a pivot pin pivotally attaching the deflector member to the substantially cylindrical member.

3. The device of claim 2, wherein:

the deflector member includes an upper portion and a longitudinally extending groove disposed in the upper portion thereof for guiding a drill bit along the deflector member.

4. The device of claim 2, wherein:

the deflector member comprises a first, relatively light weight portion on a first side of the pivot pin, and a second, relatively heavy portion on a second side of the pivot pin; and the deflector member is shaped such that, when the deflector means is in the first position, the deflector member does not extend beyond the slot in the substantially cylindrical member and, when the deflector means is in the second position, a portion of the first portion of the deflector member extends out of the slot.

5. The device of claim 4, wherein:

the slot has a bottom; and the second portion of the deflector member includes a bottom portion which is parallel to the bottom of the slot in the substantially cylindrical member when the deflector means is in the second position.

6. The device of claim 1, further comprising:

support means for supporting the deflector means in the second position.

7. The device of claim 4, wherein:

the deflector member has a support member pivotally attached to its first portion for supporting the deflector means in the second position.

8. A directional guidance device for deflecting a drill bit away from the longitudinal axis of a substantially straight, substantially horizontal section of a wellbore, the drill bit being carried by a first drill string of drill pipe with a continuous drill string flow bore extending from a surface area drill site comprising:

a substantially cylindrical housing having an elongated, longitudinally extending slot therein and a hollow bore having an open end portion for receiving the drill bit and first drill string;

a deflector member disposed in the slot and pivotally attached to the substantially cylindrical housing, the deflector member being movable between a first position in which the deflector member blocks the bore and prevents advancement of the drill bit and drill string and a second position in which the deflector member causes the drill bit to deflect from the longitudinal axis of the substantially horizontal section of wellbore, in which the device is disposed, as the drill bit is advanced;

the deflector member being shaped such that, when in the first position, it does not extend out of the slot in the substantially cylindrical housing and, when in the second position, a portion of the deflector member extends out of the slot;

a second drill string extending to the surface having a continuous bore for containing the first drill string therein in a sliding relationship so that the first drill string can move within the second drill string, and means for attaching the substantially cylindrical housing to the second drill string at the housing open end position.

9. The device of claim 8, wherein:

the deflector member is pivotally attached to the housing with a pivot pin;

the deflector member comprises a first, relatively light portion disposed on a first side of the pivot pin and a second, relatively heavy portion disposed on a second side of the pivot pin; and the portion of the deflector member which extends out of the slot when the deflector member is in the second position is a portion of the first portion of the deflector member.

10. The device of claim 9, wherein:

the slot has a bottom;

the second portion of the deflector member includes a bottom portion which is parallel to the bottom of the slot when the deflector member is in the second position; and the device further comprises a support member for supporting the deflector member in the second position.

11. The device of claim 10, wherein:

the support member comprises a substantially triangular member pivotally attached to the first portion of the deflector member.

12. A method of drilling a well, the method comprising the steps of:

(a) drilling a wellbore including a substantially straight, substantially horizontal section; and (b) drilling a plurality of offset wells from the substantially straight, substantially horizontal section of the wellbore, the offset wells including a substantially straight portion at an angle of between 10° and 45° from the substantially straight, substantially horizontal section of the wellbore; and wherein the offset wells include a substantially curved portion drilled at an angular rate of build of between 3.3° and 15° per 100 feet.

13. The method of claim 12, wherein the substantially straight portions of the offset wells are at an angle of approximately 30° from the substantially straight, substantially horizontal section of the wellbore.

14. The method of claim 12, wherein the wellbore also includes a substantially straight section at an angle of between 0° and 90°, inclusive, from horizontal and a substantially curved section connecting the two substantially straight sections.

15. The method of claim 14, wherein the substantially straight section of the wellbore is at an angle of approximately 60° from horizontal.

16. The method of claim 14, wherein the substantially curved section of the wellbore is drilled at an angular build rate of between 3° and 10° per 100 feet.

17. The method of claim 16, wherein the angular build rate is approximately 7½° per 100 feet.

18. The method of claim 12, wherein the angular rate of build of the curved portion of the offset wells is approximately 6.6° per 100 feet.

19. A method of drilling a well, the method comprising the steps of:

(a) drilling a first, substantially straight section of wellbore, at an angle between 0° and 90°, inclusive, from horizontal;

drilling a second, substantially curved section of wellbore continuous with the first section of wellbore;

(c) drilling a third, substantially straight, substantially horizontal section of wellbore continuous with the second section of wellbore; and (d) drilling a plurality of offset wells from the wellbore, including a substantially curved portion drilled at an angular rate of build of between 3.3° and 15° per 100 feet.

20. The method of claim 19, wherein the offset wells are oriented upward from the third section of the wellbore.

21. The method of claim 19, wherein the angle is between 15° and 75° from horizontal.

22. The method of claim 21, wherein the angle is between 25° and 65° from horizontal.

23. The method of claim 22, wherein the angle is approximately 60° from horizontal.

24. The method of claim 19, wherein the offset wells are drilled from the third section of the wellbore.

25. The method of claim 24, wherein the offset wells include a substantially straight portion at an angle of between 0° and 90° from the longitudinal axis of the third section of the wellbore.

26. The method of claim 25, wherein the substantially straight portion of the offset wells is at an angle of between 10° and 45° from the longitudinal axis of the third section of the wellbore.

27. The method of claim 26, wherein the substantially straight portion of the offset wells is at an angle of approximately 30° from the longitudinal axis of the third section of the wellbore.

28. The method of claim 19, wherein the substantially curved section of the wellbore is drilled at an angular build rate of between 3° and 10° per 100 feet.

29. The method of claim 28, wherein the angular build rate is approximately 7½° per 100 feet.

30. The method of claim 19, wherein the angular rate of build of the curved portion of the offset wells is approximately 6.6° per 100 feet.

* * * * *